United States Patent [19]

Anderson

[11] 4,403,206

[45] Sep. 6, 1983

[54] BALANCED SWITCH FOR THERMOSTATS OR THE LIKE

[75] Inventor: Richard M. Anderson, Shelby, Ohio

[73] Assignee: Therm-O-Disc, Incorporated, Mansfield, Ohio

[21] Appl. No.: 332,603

[22] Filed: Dec. 21, 1981

[51] Int. Cl.[3] ..... H01H 37/70

[52] U.S. Cl. ..... 337/348; 337/354; 337/367

[58] Field of Search ..... 337/348, 354, 365, 367, 337/373, 374

[56] References Cited

U.S. PATENT DOCUMENTS

| | | | |
|---|---|---|---|
| 3,428,932 | 2/1969 | Manecke | 337/348 |
| 4,117,443 | 9/1978 | Hofsass | 337/348 |
| 4,118,683 | 10/1978 | Schwarz | 337/348 |
| 4,365,228 | 12/1982 | Rowley | 337/360 |

*Primary Examiner*—George Harris

*Attorney, Agent, or Firm*—Pearne, Gordon, Sessions, McCoy, Granger & Tilberry

[57] ABSTRACT

A condition-sensing switching device is disclosed having a plurality of active switch elements which are not symmetrical with the line of action of the condition-sensing actuator. A dummy element is provided to establish symmetry and produce a balanced condition on the switch actuator. The switch elements and dummy element are arranged so that no resilient forces are applied to the actuator during a portion of the actuator movement and the resilient forces on each element simultaneously are applied in a balanced manner during actuator movement to ensure that the forces on the actuator are balanced in all positions of the actuator. An adjusting screw is provided to adjust the force of one spring to ensure that absolute balance is achieved.

5 Claims, 3 Drawing Figures

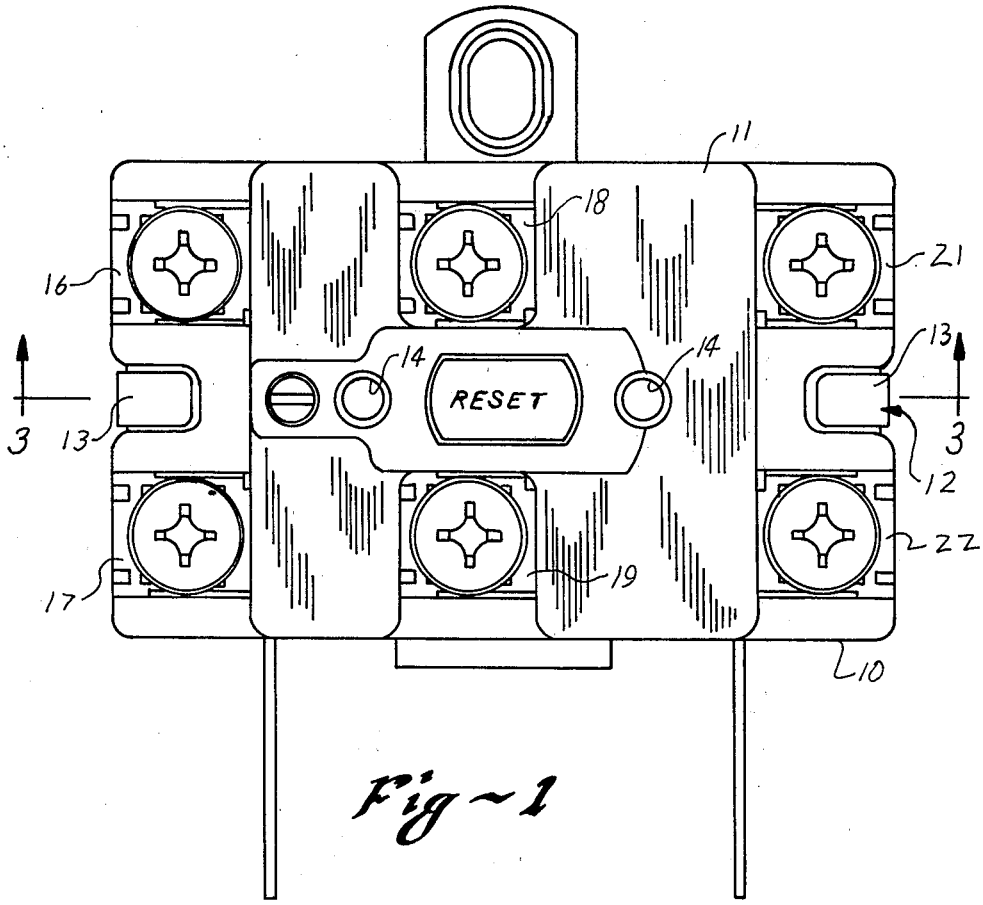
Fig ~ 1
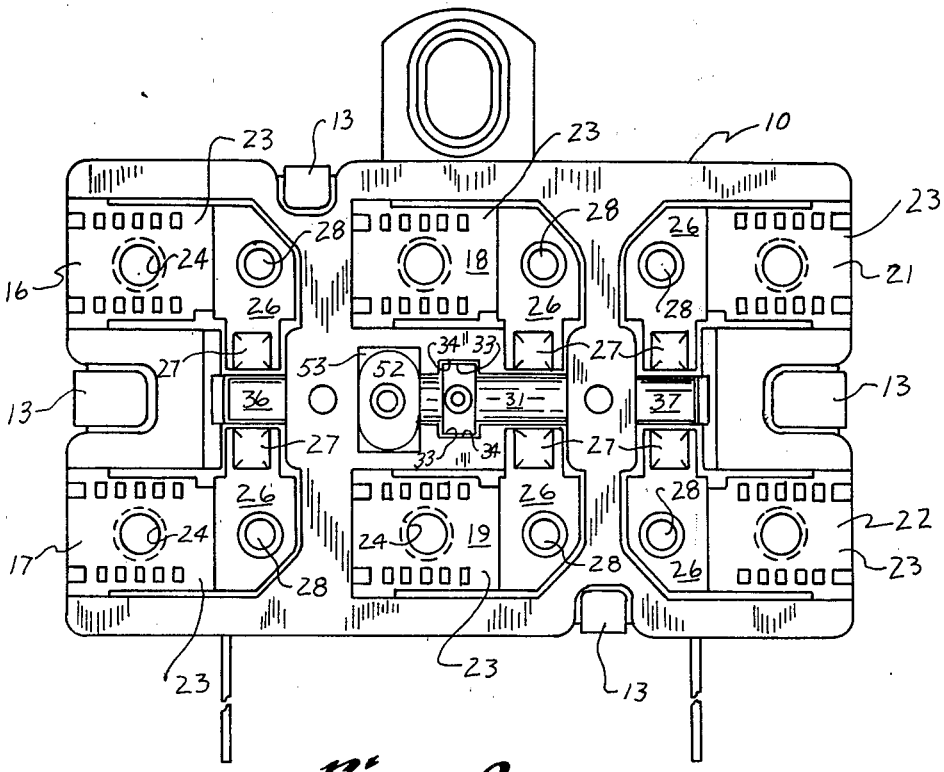
Fig ~ 2

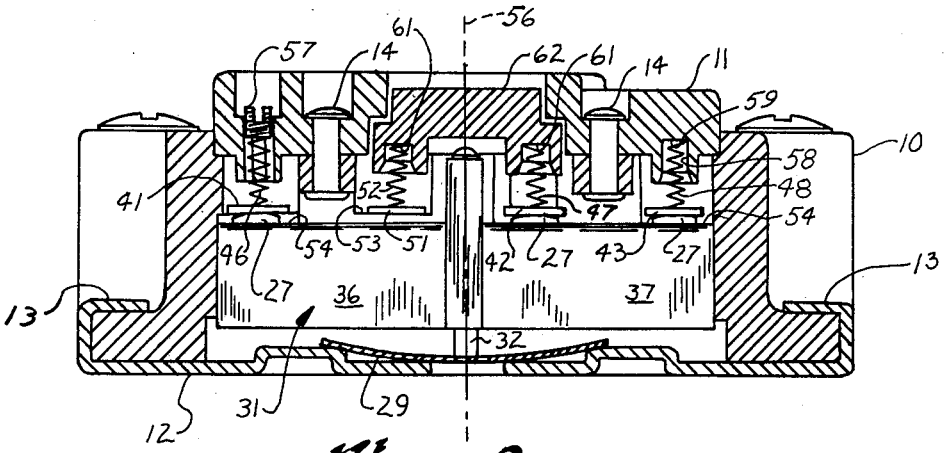
Fig ~ 3

BALANCED SWITCH FOR THERMOSTATS OR THE LIKE

BACKGROUND OF THE INVENTION

This invention relates generally to thermostats, and more particularly to a novel and improved balanced switch structure for thermostats or the like.

PRIOR ART

Thermostats and other condition-sensing devices are generally provided with an actuator which produces operating movement along a line of action in response to temperature conditions or other conditions to which the actuator responds. Such movement is, in turn, often used to operate a switching device. For example, one typical thermostat, illustrated in U.S. Pat. No. 3,219,783, provides a bimetal snap disc which responds to temperature conditions to open and close a switch through a bumper or operator. Such disc produces movement along a line of action which, in such device, is coincident with the axis of the disc. In such thermostat, the switch is a single-pole switch and is located with respect to the line of action so that the forces on the bumper are aligned with the line of action and the device is therefore balanced.

In instances in which the switch is a two-pole switch, the structure is generally arranged so that the two poles or the switch elements are symmetrically positioned on opposite sides of the line of action so that the forces on the bumper are again balanced. An example of such a two-pole thermostat is illustrated in U.S. Pat. No. 3,675,178. In such devices, where the forces on the bumper are balanced, there is little or no friction developed, and the thermostat operates with maximum temperature accuracy and is not subjected to significant wear.

When two or more even numbers of poles are provided, as in the example of the '178 patent mentioned above, the practice is to locate the poles so that a symmetrical arrangement is provided with respect to the line of action to achieve a balanced condition.

In instances in which there are an odd number of poles or switch elements, and in which one pole is not located directly in alignment with the line of action, an unbalanced condition can exist in which the bumper is subjected to lateral friction producing forces. Such unbalanced forces can adversely affect the accuracy of the device and its ability to continue to function accurately through a large number of cycles.

In one such device, two poles are located in alignment on one side of the line of action and one pole is located on the opposite side of the line of action. In such device, a dummy contact is positioned on the opposite side and the active contacts and dummy contact are positioned so that the four are symmetrically positioned with respect to the line of action. The dummy contact tends to balance the forces applied to the bumper or operator to eliminate lateral forces. Such thermostat is manufactured in France by Robertshaw, and is believed to constitute prior art with respect to this invention.

The dummy contact of such thermostat applies its force to the bumper in all positions of the disc, but the active contacts apply force to the bumper only when the switches are open. Consequently, unbalanced forces are applied to the bumper in substantial portions of the range of movement of the bumper and the disc. Such unbalanced forces produce undesirable friction, and tend to cause operating inaccuracies. Further, because the dummy contact force is applied to the disc when the active switches are closed, such force operates to change the operating temperature of the disc as it commences to snap through to the switch-open position. Still further, since unbalanced friction producing loads occur when the disc commences to snap to the switch-open position, variations in friction and any sticking resulting from friction can change the operating temperature of the device and cause inaccurate operation.

SUMMARY OF THE INVENTION

In accordance with the present invention, a novel and improved balanced switch structure is provided. Such switch is particularly adapted for use in condition-sensing devices such as thermostats or pressure sensing switches or the like.

Such switch provides an odd number of active poles which are not symmetrically located with respect to the line of action of the switch actuator, so that the active switches themselves apply an unbalanced force to the switch operator. However, balanced loading of the actuator is achieved by a dummy contact which places the system in symmetry and which produces a balanced loading on the bumper or operator in all positions thereof.

In the illustrated thermostat incorporating this invention, the switch system does not apply any force to the bumper or to the snap-acting actuator when the switch is in the switch-closed position. Therefore, the operating condition of the snap element on switch opening is not altered. Further, the absence of unbalanced loading virtually eliminates friction forces or wear which could produce operating inaccuracies.

Still further in the illustrated embodiment, means are provided to adjust the balance of the forces on the bumper to ensure complete and accurate balancing of the switch when the switch is opened.

These and other aspects of this invention are illustrated in the drawings, and are more fully described in the following specification.

BRIEF DESCRIPTION OF THE DRAWINGS

FIG. 1 is a plan view of a bimetal snap disc thermostat incorporating the present invention;

FIG. 2 is a plan view similar to FIG. 1, but illustrating the thermostat with the cover removed to illustrate the terminal structure thereof; and FIG. 3 is a side elevation in longitudinal section, taken generally along line 3—3 of FIG. 1.

DETAILED DESCRIPTION OF THE DRAWINGS

The illustrated embodiment of this invention is a three-pole switch operated by a bimetal snap disc. The device includes a housing or body assembly including a molded main body 10, a molded cover element 11, and a metal cover plate 12. The cover plate 12 is secured to the body by tabs 13, best illustrated in FIGS. 2 and 3. The cover element 11 is secured to the body by a pair of rivets 14.

A first pair of terminals 16 and 17 provide the terminal connections for a first switch. A second pair of terminals 18 and 19 provide the terminal connections for the second switch, and a third pair of terminals 21 and 22 provide the terminal connections for the third switch. FIG. 1 illustrates the terminals with the connector screws in place. However, in FIG. 2, the connector screws, along with the cover, are removed to better illustrate the structure of the device. The terminals 16 through 19 and 21 and 22 are generally similar in structure, except that half of the terminals are left-hand and the other half are right-hand. Such terminals include a surface portion 23 having a threaded opening 24 therein to receive the terminal screws. A lower portion 26 is offset from the surface portion 23 and provides a contact 27 at one extremity. A rivet 28 secures the associated terminal to the body 10.

Referring to FIG. 3, a bimetal snap disc 29 is mounted within the cover plate 12 and is movable with snap action between two positions of stability upon reaching its predetermined operating temperatures. In FIG. 3, the disc is illustrated in the downwardly curved position in which the switches are closed.

An operator 31 is guided within the body 10 for vertical movement, as viewed in FIG. 3, and is provided with a central lower projection 32 which is engageable with the center of the disc 29. As illustrated in FIG. 2, the operator or bumper is provided with opposed, rectangular projections 33 which fit into vertically extending guide grooves 34 so that the operator is guided for straight line vertical reciprocation with respect to the body 10. Oppositely extending arms 36 and 37 are formed on the operator 31 to provide the actual operation of the switches. A first bridging contact 41 (not illustrated in FIG. 2 but illustrated in FIG. 3) extends across the two contacts 27 of the terminals 16 and 17 and constitutes a movable contact member of the first switch. A second bridging contact 42 extends across the two contacts 27 of the terminals 18 and 19, and constitutes a movable contact element of the second switch. Similarly, a third movable contact 43 extends across the two contacts 27 of the terminals 21 and 22 and constitutes the movable contact of the third switch. Each of these contacts 41 through 43 is biased by an associated spring 46, 47, and 48, respectively, toward the associated fixed contacts 27, and normally maintains the bridging contacts in the switch-closed position illustrated in FIG. 3 except when the operator 31 operates to lift the bridging contacts and open the respective switches.

A dummy contact 51 is also provided for balancing purposes, as discussed below. The dummy contact does not engage any fixed contact, but is biased by a spring 52 toward a wall surface 53 on the body 10. The upper surfaces 54 of the two arms 36 and 37 operate when the bimetal snap disc 29 snaps through to its opposite position of curvature to engage the various contacts 41, 42, 43, and 51 to raise the contacts against the action of the associated springs and move the contacts to a switch-open position. It should be noted, however, that when the disc is in the switch-closed position illustrated, the upper surfaces 54 are spaced from the respective contacts by a uniform distance. The disc 29 produces its maximum movement along a line of action 56 which is coincident with the center of the disc and also coincident with the center of the operator 31. The two active contacts 41 and 43 and their associated springs 46 and 48 are located on opposite sides of the line of action and are equidistant therefrom. Similarly, the dummy contact 51 and the active contact 42 are located on opposite sides of the line of contact 56 and are equally spaced therefrom. The upper end of the spring 46 bears against an adjusting screw 57 threaded into the cover element 11 and the upper end of the spring 48 extends into the guide opening 58 in the cover member and is seated at its upper end against an end wall 59 of such opening. The two centrally located springs 47 and 52 extend into guide openings and seat against the end walls 61 thereof provided by a reset button 62. The two springs 47 and 52 serve to resiliently bias the reset button 62 toward its upper extremity of movement illustrated. In such position, the end walls 59 and 61 are coplanar and the springs have the same working lengths. If all of the springs are identical in both rate and size, the adjustment screw 57 is normally positioned so that the upper end of the spring 46 is also substantially coplanar with the end walls 59 and 61. In the switch-closed position illustrated, all of the movable contacts, including the active contacts and the dummy contact, are also coplanar. The screw 57, however, is adjusted to compensate for variations between the parts until the forces on the bumper are accurately balanced.

When the snap disc 29 commences to snap through to its opposite position of curvature, it causes the operator or bumper 31 to move upwardly toward the switch-open position. During the initial portion of such movement there is no contact between the upper surfaces 54 of the two arms 36 and 37, so there is no spring-applied force to either the operator or to the disc. However, when the upper surfaces 54 engage the respective contacts, continued upward movement of the operator is resisted by the forces of the four springs 46, 47, 48, and 52. The geometry of the system is selected so that the various contacts are engaged substantially simultaneously. Therefore, as the operator engages the contacts and commences to move the contacts with the operator, the resilient forces of the four springs are simultaneously applied to the operator. Because the respective springs and contacts are symmetrically positioned with respect to the line of action 56, the force on the two sides of the operator applied to the two arms 36 and 37 balance and there is no significant lateral force applied to the operator. Consequently, friction of any significant value does not occur.

As the operator continues to move to the fully operative position, carrying with it the various contacts, the springs are equally compressed so the forces on the operator are balanced during the movement from the initial engagement with the contacts to the full switch-open position. Therefore, there is no unbalanced force on the operator in this portion of its movement, and friction and wear do not occur.

In the illustrated embodiment, in which the thermostat is a manual reset type, the snap disc remains, after operation, in its switch-open position, until the reset button 62 is manually depressed, causing engagement between the surface 66 of the reset 62 and the upper extremity 67 of the operator. Once this engagement occurs, continued manual movement of the reset button causes the operator to press the disc back through to the illustrated position and causes the switches to be reclosed. Resetting of the thermostat, of course, cannot occur until the disc returns to a temperature in which it will remain in the reset or illustrated position, since release of the manual reset button before such temperature is reached would merely allow the disc to snap back to the operative position.

The present invention is also applicable to non-manual reset theremostats and, in such thermostats, the reset member 62 is not provided and the cover 11 is modified to bridge across the central opening therein and to provide the surfaces 61 against which the two springs 47 and 52 act. In such a device, the balanced force condition which exists eliminates any friction resisting movement of the operator with the disc when it snaps back to its switch-closed position, so accuracy of switch closing temperature is also maintained.

The adjusting screw is provided when high degrees of balance are required to ensure that virtually perfect balance is achieved. Such screw is threaded in or out, as required, to achieve substantially perfect balance of the operator and compensates for any variations which might exist in the forces produced by the respective springs. In instances in which the springs are maintained to very close tolerances, it may not be necessary to utilize an adjusting screw 57, and in such instances the spring 46 would merely bear against a wall provided in the cover 11 in the same manner as the spring 48.

By providing a dummy contact 51 and dummy contact spring 52, it is possible to achieve full symmetry and balancing even when the number of active contacts on one side of the line of action exceeds the number of active contacts on the other side of the line of action. Consequently, with this invention, full balance is achieved even with switches having an odd number of poles and where none of the poles are located directly along the line of action. Further, since the dummy contact force is applied to the operator only in those positions in which the forces of the active contacts are applied to the operator, full operator balancing is achieved in all operator positions. Further, in the illustrated embodiment in which there are no spring forces applied to the operator or disc when the disc is in the switch-closed position and commences to move toward the switch-open position, the operating temperature of the disc is not adversely affected and there is virtually no friction developed to resist the commencement of snap movement toward the switch-open position. Consequently, the maximum kinetic energy of the system is available to break any welds which might exist between the various active contacts and greater operational reliability is realized.

It should be understood that it is within the broader aspects of this invention to provide a balanced switch structure for devices other than thermostats. For example, the invention can be applied to devices in which the condition sensing bimetal snap disc is replaced by a condition sensing actuator which is sensitive to pressure or other conditions.

Although the preferred embodiment of this invention has been shown and described, it should be understood that various modifications and rearrangements of the parts may be resorted to without departing from the scope of the invention as disclosed and claimed herein.

What is claimed is;

1. A condition-sensing switch comprising a body, a condition-sensing actuator mounted on said body operable to produce switch operating movement along the line of action, an odd number of resiliently-biased active switch elements mounted on said body on opposite sides of said line of action, with a number of switch elements on one side of said line of action exceeding the number of switch elements on the other side thereof, an operator operable to simultaneously move said switch elements in response to the operation of said condition-sensing actuator, an at least one resiliently-biased dummy element mounted on said body on said other side of said line of action and cooperating with said active switch elements to provide a symmetrical arrangement of elements with respect to said line of action, said dummy element and switch elements cooperating to cause the resilient forces on said operator to be balanced in all positions of said actuator.

2. A condition-sensing switch as set forth in claim 1 wherein said operator moves through a predetermined range of movement, and said resiliently-biased elements exert forces on said operator only when said operator is in one portion of said range of movement and do not exert forces on said operator in the remaining portions of said range of movement.

3. A condition-sensing switch as set forth in claim 1 wherein adjusting means are provided to adjust the resilient force on one of said elements to ensure that the forces applied to said operator are fully balanced with respect to said line of action.

4. A condition-sensing switch as set forth in claim 1, wherein said condition-sensing actuator is a snap disc and said operator engages said disc substantially at the center thereof, and guide means operate to guide said operator for longitudinal movement within said body.

5. A condition-sensing switch as set forth in claim 4 wherein said actuator is a bimetal snap disc.

* * * * *